United States Patent [19]

Ritter

[11] Patent Number: 4,463,720

[45] Date of Patent: Aug. 7, 1984

[54] CENTRIFUGAL RPM GOVERNOR FOR FUEL INJECTED INTERNAL COMBUSTION ENGINES

[75] Inventor: Ernst Ritter, Stuttgart, Fed. Rep. of Germany

[73] Assignee: Robert Bosch GmbH, Stuttgart, Fed. Rep. of Germany

[21] Appl. No.: 425,819

[22] Filed: Sep. 28, 1982

[30] Foreign Application Priority Data

Jun. 30, 1982 [DE] Fed. Rep. of Germany ..... 3224358

[51] Int. Cl.[3] ..... F02D 31/00

[52] U.S. Cl. ..... 123/364; 123/374; 73/510

[58] Field of Search ..... 123/364, 365, 368, 373, 123/374; 73/510, 535, 536, 539

[56] References Cited

U.S. PATENT DOCUMENTS

| | | | |
|---|---|---|---|
| 2,256,715 | 9/1941 | Kirschner | 73/510 |
| 2,274,609 | 2/1942 | Edwards | 123/374 |
| 2,290,797 | 7/1942 | Benjamin | 123/373 |
| 2,317,022 | 4/1943 | Benjamin | 123/373 |
| 2,572,096 | 10/1951 | Baker | 73/510 |
| 2,669,983 | 2/1954 | Reddy et al. | 73/510 |
| 3,053,096 | 9/1962 | Hanley et al. | 123/373 |
| 3,125,086 | 3/1964 | Fox et al. | 123/374 |
| 3,797,470 | 3/1974 | Beck | 123/373 |
| 4,067,303 | 1/1978 | Aoki | 123/368 |

FOREIGN PATENT DOCUMENTS

| | | | |
|---|---|---|---|
| 286030 | 3/1970 | Austria . | |
| 1200063 | 9/1965 | Fed. Rep. of Germany . | |
| 2519740 | 11/1975 | Fed. Rep. of Germany | 123/372 |
| 2803323 | 8/1978 | Fed. Rep. of Germany | 123/368 |

*Primary Examiner*—Magdalen Y. C. Moy

*Attorney, Agent, or Firm*—Edwin E. Greigg

[57] ABSTRACT

A flyweight governor comprising first and second sets of flyweights disposed pivotably on a flyweight support, the flyweights of the first set are arrested by stops after having traversed an idle speed angle of traverse ($\alpha_{LL}$), on which stops the flyweights of said second set rest only after having traversed the total angle of traverse ($\alpha_{max}$). The flyweight masses of the first set of flyweights acting only in the idle speed control have, in their position of rest, an outer contour which is, in comparison to said second set of flyweights, displaced further outwardly with an inclination angle ($\beta_{LL}$) to the rotational axis (A) corresponding to the idle speed angle of traverse ($\alpha_{LL}$). The flyweight governor can be used in particular for the idle speed-maximum speed rpm governors of Diesel engines for vehicles and causes a large reduction of the centrifugal forces ordinarily appearing at maximum rpm, while at the same time allowing an increase in the performance capacity in the idle speed control range.

3 Claims, 1 Drawing Figure

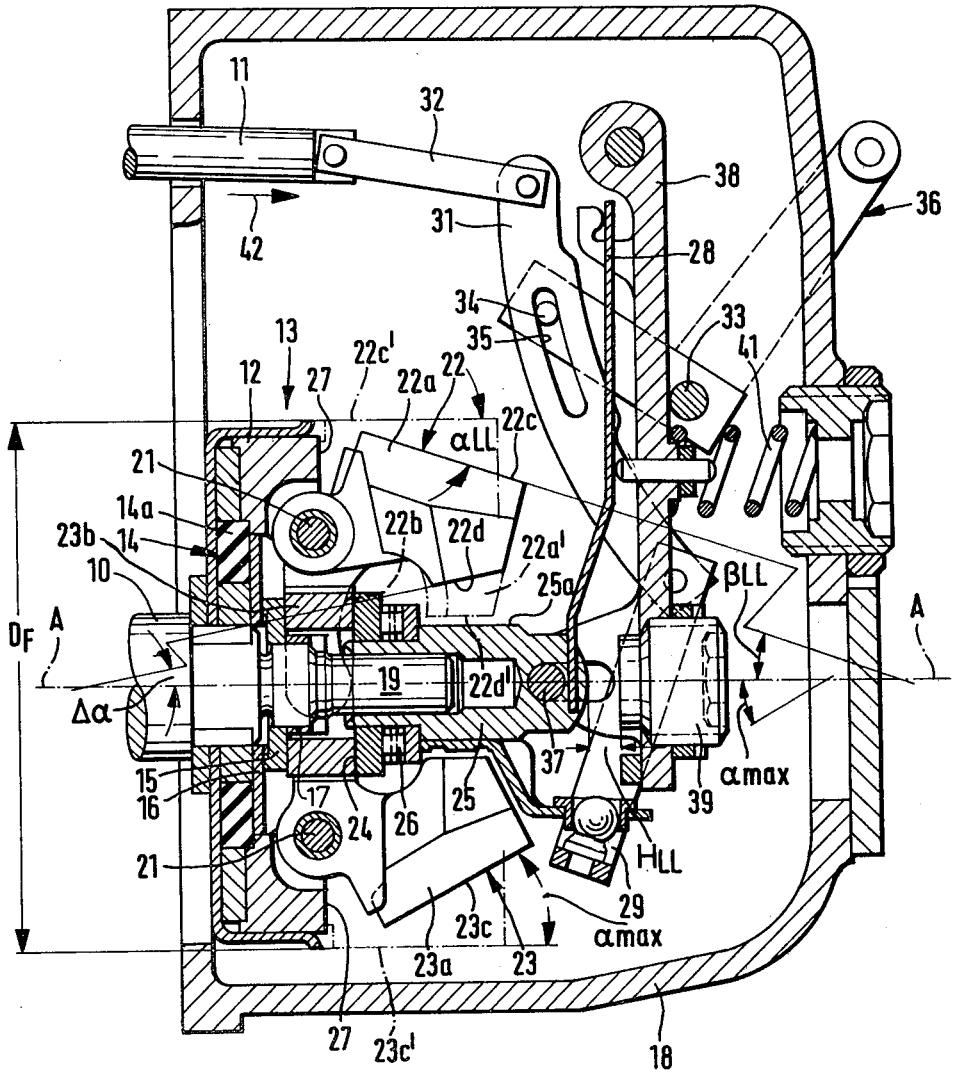
11
32
38
36
42
31
28
34
35
33
41
13
22c'
22a
22
12
27
αLL
22c
21
14a
23b
14
10
22b
22d
22a'
25a
βLL
DF
A
A
19
22d'
Δα
37
αmax
15
16
17
24
26
25
39
21
HLL
29
23c
αmax
23a
23
27
23c'
18

CENTRIFUGAL RPM GOVERNOR FOR FUEL INJECTED INTERNAL COMBUSTION ENGINES

BACKGROUND OF THE INVENTION

The present invention is based on a centrifugal rpm governor for fuel injected internal combustion engines. A centrifugal rpm governor of construction in accordance with the species is already known (Austrian Pat. No. 286 030) having two sets of flyweights which can be turned off in succession. In this known centrifugal governor the first sets of flyweights consisting of four weights is only active in the area of idling control. The four weights take the same position as the remainder of the flyweights, which act in the upper rpm area, during the inactive phase of the governor, and is checked by stops mounted on the flyweight support after traversing a predetermined angle. This has the disadvantage that the remainder of the angle of traverse, which would allow a larger centrifugal radius, is not utilized during the idling control, however, in the known rpm governor this is balanced by having double the amount of flyweights active during the idling control. Other rpm governors are known with sets of flyweights capable of being turned off in succession, which, for instance, provide the necessary adjustment force by means of differing lever ratios or by having differing weights in the lever control range. That is, the one serving as idling control provides a sufficiently large adjustment force with only two light flyweights in the higher rpm ara, because of the centrifugal force which increases by the square. This makes it possible to keep the setting or adjustment forces during the setting of the rpm governor springs and the dimensioning of the springs themselves in an area favorable for their manufacture and easily controllable.

The present invention has the purpose of improving a centrifugal rpm governor, especially for use in rpm governors for idling and maximum control for Diesel engines in vehicles, in such a way, that the centrifugal radius possible is optimally utilized and that thereby a necessary increase of the number of flyweights acting in the idling control range over the flyweights acting only in the maximum speed range can be avoided.

OBJECT AND SUMMARY OF THE INVENTION

The centrifual rpm governor has the advantage, that with the same stops, the flyweights acting during the idling control can exert a large centrifugal force at low rpm because their outer contours are shifted outwardly, which correspondingly increases the centrifugal radius, than known flyweights, which only pivot outwardly from the inner position by the amount of the idle speed angle of traverse. This leads to an optimal utilization of the extreme pivot position, determined by the maximally permissible centrifugal circle diameter, of the flyweights acting during the idling control, in order to attain the greatest possible centrifugal force.

If the centrifugal rpm governor, as is known from the patent cited above, has equal size flyweight masses or each flyweight, then the characteristics set forth herein provide optimal extension and advantageous use of the centrifugal forces available.

By means of the characteristics set forth, the entire space available for installation is utilized for the flyweights acting during the idling control and thereby their centrifugal mass is increased because of the outwardly displaced center of the centrifugal force in accordance with the present invention.

The invention will be better understood and further objects and advantages thereof will become more apparent from the ensuing detailed description of a preferred embodiment taken in conjunction with the drawings

BRIEF DESCRIPTION OF THE DRAWING

An exemplary embodiment of the centrifugal rpm governor according to the present invention is shown in the drawing in longitudinal cross-section and described as follows:

DESCRIPTION OF THE PREFERRED EMBODIMENT

The flyweight support 12 of a flyweight governor 13 is disposed on a camshaft 10, serving as the drive shaft of the governor, of an injection pump of an internal combustion engine not further shown, with the exception of a control rod 11. The flyweight support, by reason of the large masses to be accelerated, is fastened onto the camshaft by means of cover plates 15 and 16 and a round nut 17 and with the interpositioning of an oscillation damper 14 containing a rubber element **14*a* on a shaft stub 19 of the camshaft 10 which extends into the interior of the governor housing 18. The flyweight support 12 contains four bearing bolts 21, of which two are shown in the drawing, offset by 90° in cross section, forming a pivot bearing for each of the angular flyweights numbered 22 and 23**.

The flyweight 22 represents one of two flyweights exclusively used for the idle control and consists of a flyweight mass **22*a* and of a pressure arm 22*b*, disposed at about right angles to it. In order to keep the drawing uncomplicated, the second flyweight 22 disposed opposite of this flyweight 22 is not shown, in its place one of the flyweights 23, offset at 90° from the flyweights 22, is shown, which are also used in the idle control, but which alone are used in the maximum speed control. Its flyweight mass is designated 23*a* and it has a pressure arm 23*b*. Both pressure arms 23*b* of the flyweights 23 are, in relation to the representation of the flyweight 22, shown in cross section in their correct positions and are disposed, at least in the idle range, resting against the end face 24 of a governor sleeve 25. The end face 24 is formed by a pressure bearing 26 fastened on the governor sleeve 25. All pressure arms 22*b* and 23*b* of the flyweights 22 and 23 take on the same starting position during the rest position of the flyweights 22 and 23. The starting position extends at least almost vertically to an axis of rotation A of the governor. The axis of rotation A is, at the same time, the longitudinal axis of the drive shaft 10 and of the governor sleeve 25**.

The flyweight support 12 is equipped with stops 7, which are identical for all flyweights 22 and 23, and against which the flyweights 22 and 23 rest when in their extreme pivoted position, which is determined by the largest permissible centrifugal circle diameter $D_F$. This extreme pivot position of the two flyweights 22 and 23 is shown respectively by dash-dotted lines. The idle speed angle of traverse $\alpha_{LL}$, corresponding to an idle speed sleeve travel $H_{LL}$ of the governor sleeve 25, is shown for simplicity's sake as the angle of traverse of an outer contour **22*c* of the flyweight 22. After traversing the angle of traverse $\alpha_{LL}$, the outer contour 22*c* is in its extended position 22*c*', shown by a dash-dotted line, which forms the centrifugal circle diameter $D_F$ according to the present invention. An outer contour of the flyweight 23 is, correspondingly, designated as 23c and moves through a total angle of traverse $\alpha_{max}$, which is proportional to the maximal sleeve travel not shown, and attains an extended position 23c'**, indicated by a dash-dotted line, after traversing this angle of traverse.

As shown by solid lines, the flyweight mass 22a is as great as the flyweight mass 23a, however, in the position of rest shown it is already shifted outwardly far enough that the outer contour 22c is inclined by an inclination angle $\beta_{LL}$, corresponding to the idle speed angle of traverse $\alpha_{LL}$, to the axis of rotation A. In difference from the foregoing, however, it is also possible, in order to increase the centrifugal forces operating during the idle control, to increase the volume of the flyweight mass 22a of the flyweights 22, which are only operational during idle control, in relation to the other flyweights 23 and to increase their inner contours until they touch the surface 25a of the governor sleeve 25. This variation of an embodiment is shown by dash-dotted lines and the associated flyweight mass is designated as 22a' and the inner contour of the latter with 22d.

If, for the sake of simplified construction and with sufficient work capacity, the flyweight masses 22a of the flyweights 22 are of the same size as the flyweight masses 23a of the remaining flyweights 23, as shown by solid lines, the flyweight masses 22a take on an initial position pivoted outwardly by the amount of the angle difference $\Delta\alpha$ between the total angle of traverse $\Delta_{max}$ and the idle speed angle of traverse $\alpha_{LL}$ while still in the position of rest. This angle difference $\Delta\alpha$ can be read from the inclination angle assumed by the inner contour 22d of the flyweight 22 in the initial position shown in respect to the axis of rotation A.

Although the flyweight governor 13 described above can be utilized in different types of idle-maximum speed rpm controls, for the purpose of showing the governor functioning, the most important parts of an idle-maximum speed rpm governor, equipped with an idler spring 28 formed as a leaf spring, are shown in the drawing. The governor sleeve 25, movable in the direction of the axis of rotation of the governor, actuates the control rod 11 of the associated injection pump via a shift lever 29, a control rod 31 and a tongue 32. By means of an adjustment lever arrangement 36, pivotable around the pivot shaft 33 in the governor housing 18 and acting via a pin 34 on a guide slot 35 of the control rod 31, the position of the control rod 11 can be changed at will in an already known manner. The governor sleeve 25, already touching the idler spring 28 via a pressure pin 37, rests against a stop 39, adjustably secured to a power transfer lever 38, after having traversed the idle speed traverse travel $H_{LL}$ and shifts the power transfer lever 38 against the force of a main control spring 41 only after the maximum rpm have been reached and in doing so traverses the maximal sleeve travel path not further shown. The control rod 1 is thereby moved in the direction of the arrow 42 into its stop position.

The centrifugal rpm governor according to the present invention operates as follows:

With flyweights 22 and 23, shown in their position of rest, the idler spring 28, also acting as starter spring, retains the governor sleeve 25 in its initial position, whereby the control rod 11 is already moved into a starting position, which is dependent on the position of the adjustment lever 36 and which can be shifted into a starting position beyond the maximum speed position by means of pivoting the adjustment lever 36 in a counter clock-wise direction for a cold start. If the internal combustion engine runs at idle speed after starting, the flyweights 22 and 23 take up a position located within the idle speed angle of traverse $\alpha_{LL}$. When the idle speed rpm are exceeded and if the adjustment lever arrangement 36 remains in the idle position, the full idle speed angle of traverse $\alpha_{LL}$ is traversed and the flyweights 22, serving purely for the idle control, rest on the respective stops 27. If the adjustment lever arrangement 36 is pivoted into the maximum load position, not shown, then the rpm continues to climb, the flyweights 22 remain in their extended position indicated by 22c', and only the flyweights 23 act on the governor sleeve 25. When the maximum speed rpm are exceeded, flyweights 23 also have traveled the total angle of traverse $\alpha_{max}$ and rest in the extended position 23c' shown by dash-dotted lines, which controls the stop position of the control rod, against the corresponding stops 27 of the flyweight support 12.

The centrifugal ratio is reduced from 1:70 to 1:30 by means of the apparatus in accordance with the present invention. An even smaller ratio can be obtained by an increase of the weight of the flyweights 22 corresponding to the flyweight mass 22a'.

The foregoing relates to a preferred exemplary embodiment of the present invention, it being understood that other embodiments and variants thereof are possible within the spirit and scope of the invention, the latter being defined by the appended claims.

What is claimed and desired to be secured by Letters Patent of the Unites States is:

1. A centrifugal rpm governor for injected internal combustion engines, in particular idle speed-maximum speed governors for Diesel engine in vehicles which comprises: a flyweight support, flyweight stops on said support, first and second sets of angular flyweights pivotably disposed about bearing bolts, each being equally spaced bearing bolts from a rotational axis of said flyweight support, a governor sleeve movable in the direction of the rotational axis of the governor; each of said flyweights including a flyweight mass and a pressure arm which, at least in the idle speed control range lie with said pressure arms against said governor sleeve, said stops on the flyweight support functioning to arrest said first pair of flyweights after having traversed an idle speed angle of traverse ($\alpha_{LL}$) proportional to an idle sleeve travel ($H_{LL}$), and against which the flyweights of said second set rest only after having traversed a total angle of traverse ($\alpha_{max}$) proportional to the maximal sleeve travel, wherein said pressure arms of all flyweights in their rest position assume an identical initial position extending at least about vertically to the rotational axis of said governor, wherein said pressure arms have identical shapes and lengths, said stops on said flyweight support are formed identically and limit an extreme pivot position, determined by the maximally permissible centrifugal circle diameter ($D_F$), of all flyweights and in that the flyweight masses of the flyweights of said first set, which are only active in the idle speed control, have in their position of rest, an outer contour displaced further outwardly in comparison to the flyweight masses of said second set of flyweights, having an inclination angle ($B_{LL}$) to the rotational axis (A) corresponding to the idle speed angle of traverse ($\alpha_{LL}$).

2. A centrifugal rpm governor in accordance with claim 1, characterized in that said flyweight masses of said first set of flyweights which are only active in the idle speed control, have a larger volume, in comparison to the flyweight masses of said second set of flyweights and are formed with their inner contours touching a surface of the governor sleeve.

3. A centrifugal rpm governor for injected internal combustion engines, in particular idle speed-maximum speed governors for Diesel engines in vehicles which comprises: a flyweight support, flyweight stops on said support, first and second sets of angular flyweights pivotably disposed on said flyweight support, a governor sleeve movable in the direction of the rotational axis of the governor; each of said flyweights including a flyweight mass and a pressure arm which, at least in the idle speed control range lie with said pressure arms against said governor sleeve, said stops on the flyweight support functioning to arrest said first pair of flyweights after having traversed an idle speed angle of traverse ($\alpha_{LL}$) proportional to an idle sleeve travel ($H_{LL}$), and against which the flyweights of said second set rest only after having traversed a total angle of traverse ($\alpha_{max}$) proportional to the maximal sleeve travel, wherein said pressure arms of all flyweights in their rest position assume an identical initial position extending at least about vertically to the rotational axis of said governor, characterized in that said stops on said flyweight support are formed identically and limit an extreme pivot position, determined by the maximally permissible centrifugal circle diameter ($D_F$) of all flyweights, in which said first and second sets of flyweights are of equally sized flyweight masses in which the flyweight masses of said first set of flyweights, which are only active in the idle speed control, take up an initial position in their position of rest which is, in comparison with the flyweight masses of said second set of flyweights, pivoted outwardly in an amount of the angle difference ($\Delta\alpha$) between a total angle of traverse ($\alpha_{max}$) and an idle speed angle of traverse ($\alpha_{LL}$).

* * * * *